US011183108B2

(12) United States Patent
Zhang et al.

(10) Patent No.: US 11,183,108 B2
(45) Date of Patent: Nov. 23, 2021

(54) SYSTEM AND METHOD FOR REDUCING MOTION BLUR FOR LED DISPLAY

(71) Applicant: SCT LTD., Grand Cayman (KY)

(72) Inventors: Yi Zhang, San Jose, CA (US); Eric Li, Danville, CA (US); Raymond Ho, Belvedere (GB); WeiHao Chang, Hsinchu (TW); Juinn-Yan Chen, Fremont, CA (US); Shang-Kuan Tang, Fremont, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 16/945,718

(22) Filed: Jul. 31, 2020

(65) Prior Publication Data

US 2020/0388211 A1 Dec. 10, 2020

Related U.S. Application Data

(60) Provisional application No. 62/857,017, filed on Jun. 4, 2019.

(51) Int. Cl.

| | |
|---|---|
| ***G09G 3/30*** | (2006.01) |
| ***G09G 3/36*** | (2006.01) |
| ***G09G 3/32*** | (2016.01) |

(52) U.S. Cl.

CPC ..... *G09G 3/32* (2013.01); *G09G 2310/08* (2013.01); *G09G 2320/0247* (2013.01); *G09G 2320/0693* (2013.01); *G09G 2340/12* (2013.01)

(58) Field of Classification Search

CPC ..... G09G 3/06–19; G09G 3/22–3696; G09G 2300/06–0895; G09G 2310/0243–0297

See application file for complete search history.

(56) References Cited

U.S. PATENT DOCUMENTS

| | | | | |
|---|---|---|---|---|
| 2003/0090445 | A1* | 5/2003 | Chen | G09G 3/3225 345/76 |
| 2015/0279267 | A1* | 10/2015 | Tien | H05B 45/325 345/690 |
| 2018/0108311 | A1* | 4/2018 | Wang | G09G 3/36 |
| 2019/0147795 | A1* | 5/2019 | Yao | G09G 3/32 345/691 |

* cited by examiner

*Primary Examiner* — Sanghyuk Park

(74) *Attorney, Agent, or Firm* — Novick, Kim & Lee, PLLC; Allen Xue

(57) ABSTRACT

A method for motion blur in an LED display system includes the steps of connecting an LED display panel to a driver circuit; sending, from a transmitter, image data in a plurality of image frames at a predetermined frame rate and a predetermined refresh rate to the driver circuit, wherein each of the plurality of image frames has a frame time period ($T_{frame}$) comprising a plurality of refresh time periods ($T_{refresh}$); outputting a driving current in the driver circuit to drive the LED display; and turning off the driving current for a period of time ($T_{inactive}$). $T_{inactive}$ bridges two adjacent frame time periods. The value of $T_{inactive}$ can be determined according to a viewer of persistence of vision or by calibrating the LED display.

7 Claims, 6 Drawing Sheets

SYSTEM AND METHOD FOR REDUCING MOTION BLUR FOR LED DISPLAY

RELATED APPLICATION

This application claims the benefit of priority under 35 U.S.C. § 119 to U.S. Provisional Application No. 62/857,017, filed on Jun. 4, 2019, the entire contents of which are incorporated herein by reference.

BACKGROUND

1. Field of Technology

This disclosure provides method and system to reduce motion blur in an LED display system.

2. Description of Related Art

The LED display panel displays moving visual images one image frame a time at a certain number of frames per second (FPS). $T_{frame}$ is the time duration allocated to an image frame, which is the inverse of the frame rate. The image is also displayed repeatedly at a certain refresh rate. When the refresh rate is a constant, each display pixel lights up for a time proportional to the intended brightness for that pixel during a fixed time period, i.e., $T_{refresh}$. Further, pixels in the LED display light up at different times within $T_{refresh}$ so that the whole image is displayed once during one $T_{refresh}$.

Nowadays most LED displays have a refresh rate of at least 400 Hz and as high as 10,000 Hz, which translates to a $T_{refresh}$ in the range of 0.01 ms to 2.5 ms. $T_{frame}$ is determined by data from the source, which typically has a frequency of 25 Hz, 30 Hz, 50 Hz, 60 Hz, 120 Hz, or 240 Hz. Accordingly, $T_{frame}$ could be up to a few hundred times the value of $T_{refresh}$. FIG. 1 provides an example in which $T_{frame}$ is four times the length of $T_{refresh}$, which is shown as one of the four segments in one $T_{frame}$. The same image (also referred to as "content" or "data" in this disclosure), e.g., Content 1, is displayed fully in one segment so that it is displayed four times in succession during one $T_{frame}$.

Motion blur may occur in an LED display running at a constant refresh rate. When a viewer observes the moving image on the display, the viewer sees both Content 1 and Content 2 when both are shown within the persistence of vision of human eye ($T_{persistence}$). For example, when $T_{persistence}$ is about $2T_{refresh}$, the viewer may see two overlapped images. When $T_{persistence}$ is higher than $3T_{refresh}$, the viewer can see the overlapping of three or more different images. For example, Content 1 in the last segment in Frame 1 and Content 2 in the first segment in Frame 2 may be displayed within one $T_{persistence}$, causing motion blur. In general, as long as different images are shown within one $T_{persistence}$, the viewer will see blurry images such as those in FIG. 2. Since $T_{persistence}$ is typically larger than 1/30 s, much higher than a typical $T_{refresh}$ of a modern LED display, motion blur is a persistent problem for the LED display.

Accordingly, there is a need for systems and methods that reduce motion blur in LED displays.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, the current disclosure provides a method for motion blur in an LED display system. The method includes the steps of connecting an LED display panel to a driver circuit; sending, from a transmitter, image data in a plurality of image frames at a predetermined frame rate and a predetermined refresh rate to the driver circuit, wherein each of the plurality of image frames has a frame time period ($T_{frame}$) comprising a plurality of refresh time periods ($T_{refresh}$); dividing $T_{frame}$ into a first time period ($T_{active}$) and a second time period ($T_{inactive}$), outputting a driving current in the driver circuit to drive the LED display while turning off the driving current during $T_{inactive}$. $T_{inactive}$ bridges two adjacent frame time periods.

According to one aspect of the embodiment, $T_{inactive}$ has a value that is larger than or equal to ($T_{persistence}-T_{refresh}$), wherein $T_{persistence}$ is a time period for persistence of vision of human eye.

According to another aspect of the embodiment, $T_{inactive}$ is obtained by visual calibration of the LED display. The calibration includes the steps of adjusting a length of the time period when the driving current is turned off; recording the length of the time period when motion blur is at an acceptable level; and setting $T_{inactive}$ to a value at or higher than the recorded length of time period.

According to further aspects of the embodiment, $T_{inactive}$ may be implemented by sending a control signal from a transmitter to the driver circuit to turn off the driving current. Such a control signal can be a latch enable signal.

In a further aspect of the embodiment, $T_{inactive}$ is accomplished according to configuration data loaded into the plurality of configuration registers in the driver circuit. For example, the gain adjustment setting of the current source can be set to turn off the output current.

Other features and aspects will be apparent from the following detailed description, the drawings, and the claims.

Figure 1:
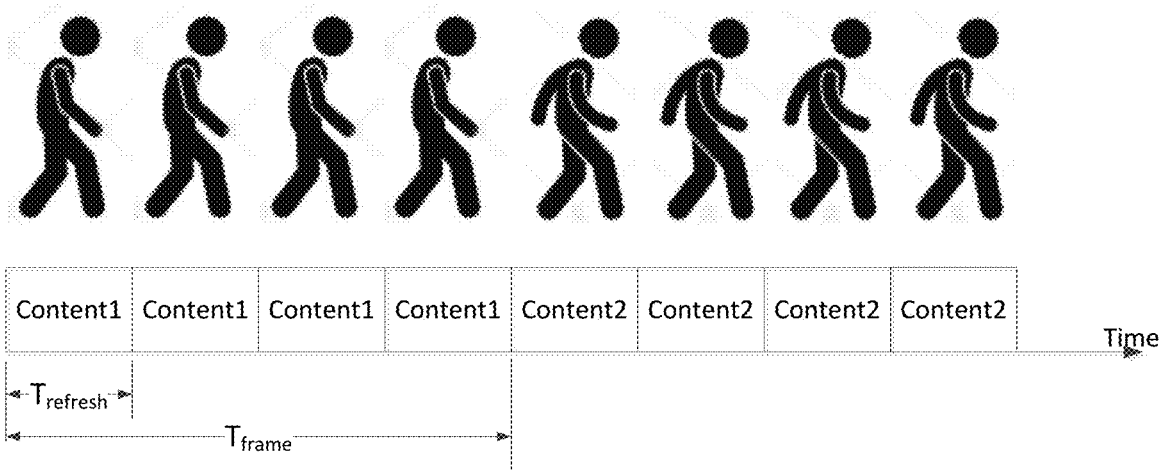
FIG. 1 illustrates the relation between $T_{frame}$ and $T_{refresh}$.
Figure 2:
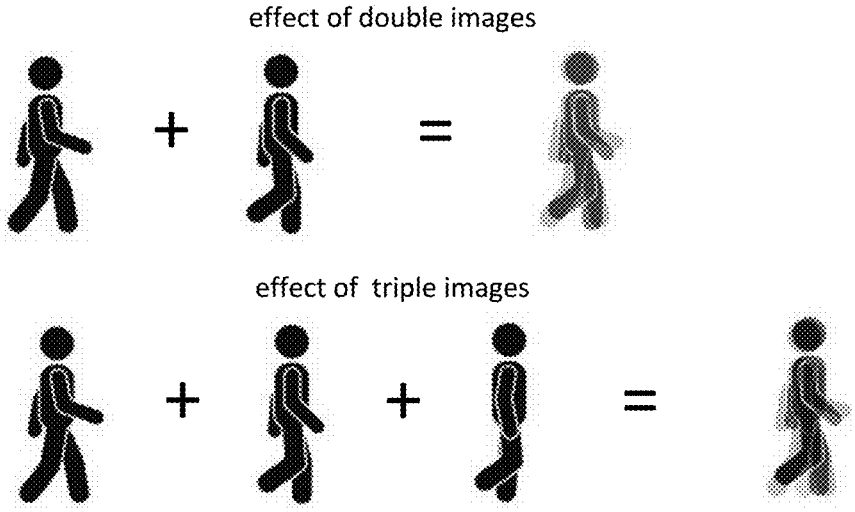
FIG. 2 illustrates motion blur.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses, and/or methods described herein will be apparent to one of ordinary skill in the art.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 3:
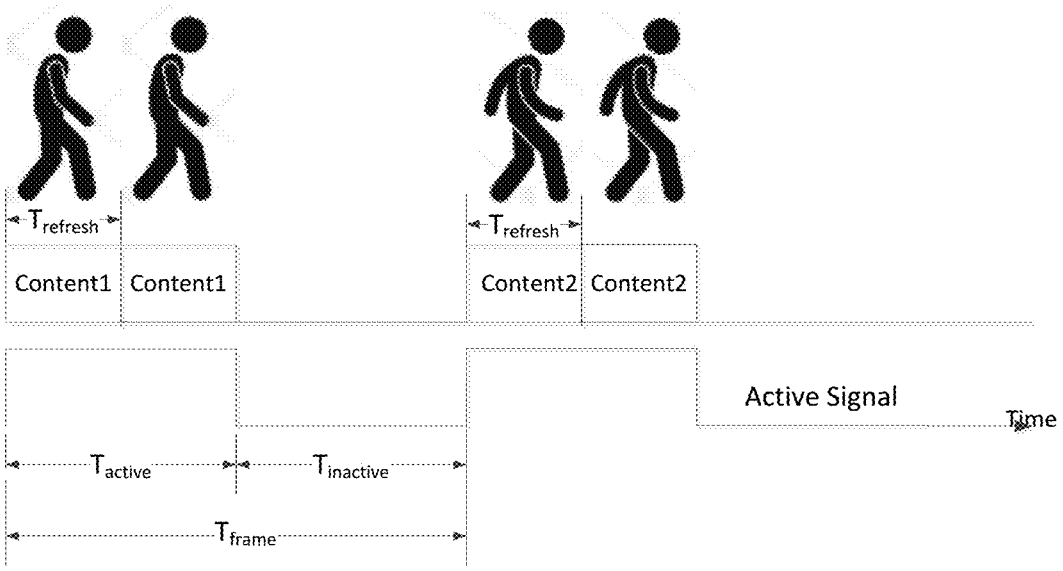
FIG. 3 illustrates one embodiment of the current disclosure that reduces motion blur.

FIG. 3 illustrates an embodiment of the current disclosure. In this embodiment, one frame time $T_{frame}$ is divided into an active period ($T_{active}$) when the display pixels are lit and a black-out period ($T_{inactive}$) when the pixels are turned off so the display is dark. The objective is to have only one single image (e.g., Content 1) appear during one $T_{persistence}$ period. Therefore, $T_{inactive}$ shall be equal to or larger than the value of ($T_{persistence}-T_{refresh}$) to avoid motion blur. Note that $T_{refresh}$ varies for different LED displays while $T_{persistence}$ also varies so that $T_{inactive}$ needs to be adjusted for difference LED displays to reduce or eliminate motion blur. On the other hand, too long a $T_{inactive}$ may cause flickering of the image so that $T_{inactive}$ shall be adjusted to a right length to minimize the flickering.

Figure 4:
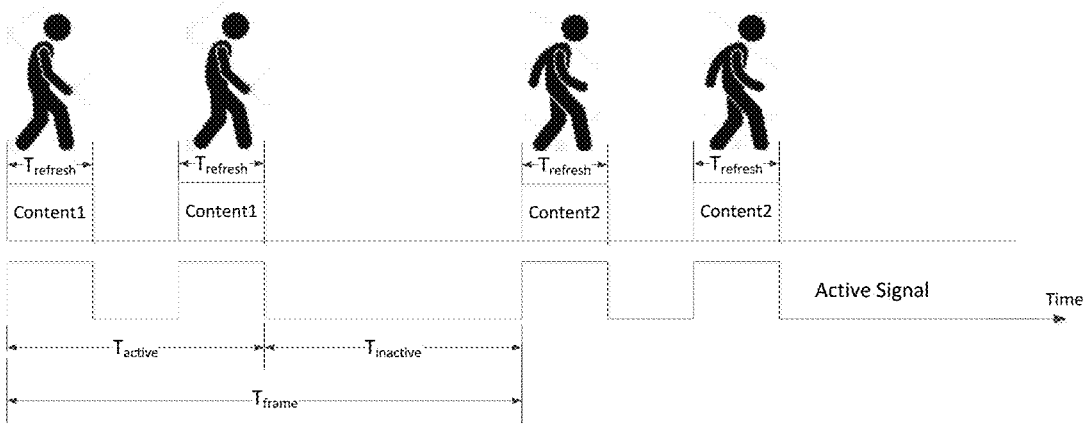
FIG. 4 illustrates another embodiment of the current disclosure.

According to one embodiment in this disclosure, a certain number of segments in the $T_{active}$ portion are selectively turned off. That is, the LED display is not continuously ON during the $T_{active}$ period so as to adjust the light intensity of the LED display. FIG. 4 shows an exemplary timing sequence according to this embodiment. According to FIG. 4, $T_{active}$ includes three segments. The pixels are lit during the first and the third segments but run dark during the second segment. The timing sequence of FIG. 4 inserts an additional black-out period into $T_{active}$ so that the total black-out time is increased without increasing the continuous black-out period. In other words, this timing sequence breaks down the total black-out time into two or more black-out periods. When properly timed, this timing sequence may reduce motion blur without causing flickering.

Figure 5:
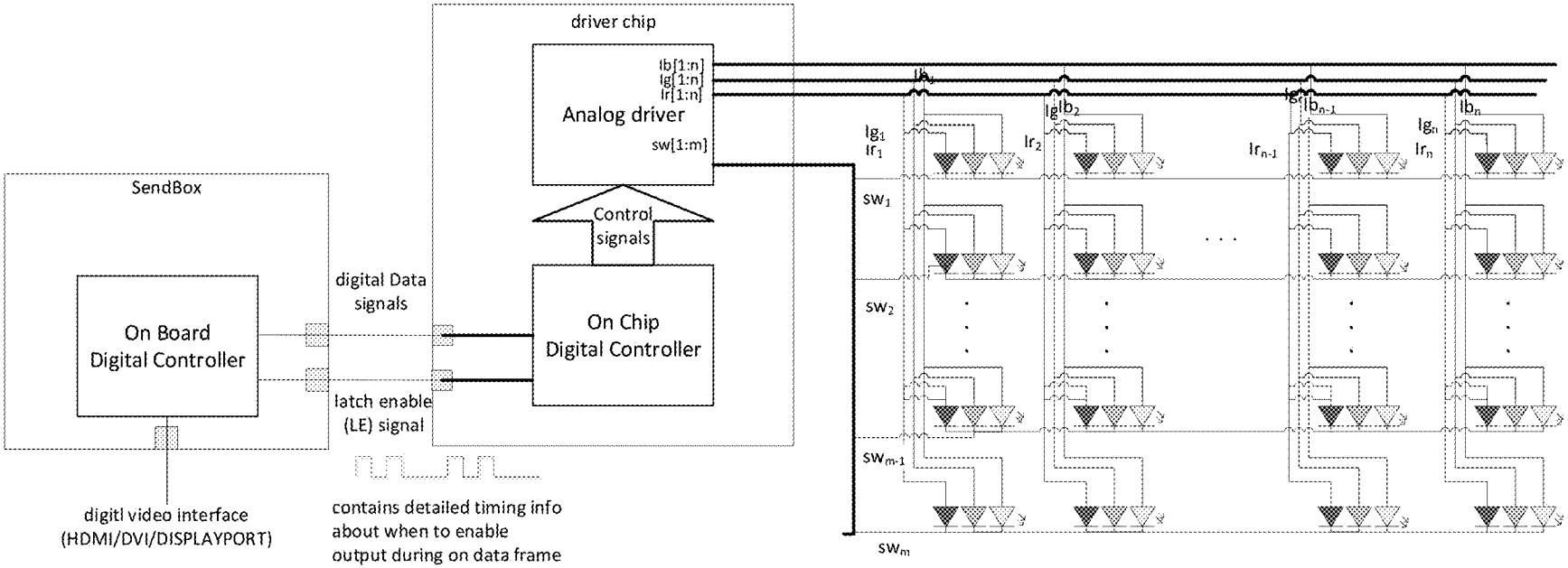
FIG. 5 is a block diagram of an exemplary system that implements embodiments of the current disclosure.

FIG. 5 is a schematic diagram showing an exemplary system of the current disclose that implements methods in the embodiments. The system includes a transmitter that receives signals from a video source and transmit image data and configuration data to the driver chip. The transmitter can be a SendBox having a circuit that includes a on board digital controller, a digital video interface (e.g. HDMI, DVI, display port, etc.), as well as ports for outputting digital signals. The diver chip includes a driver circuit that include an on chip digital controller (which includes PWM engines, etc.) and an analog driver (which includes constant current drivers, etc.). The output from the analog driver circuit drives the array of display pixels, in this case, a scan-type, m×n array of RBG LEDs.

The register on the SendBox stores the start and stop times of $T_{active}$ (i.e., the duration of the pulse). During operation, the SendBox sends an active signal to the driver circuit on the driver chip. The register on the driver chip receives and stores the start and stop time of $T_{active}$. The digital controller in the driver circuit translates the timing signals into PWM pulses. The driver chip thus outputs current to drive the LED panel according to the signals from the SendBox. During $T_{inactive}$, no current is sent to the LED pixels so they stay dark.

Figure 6:
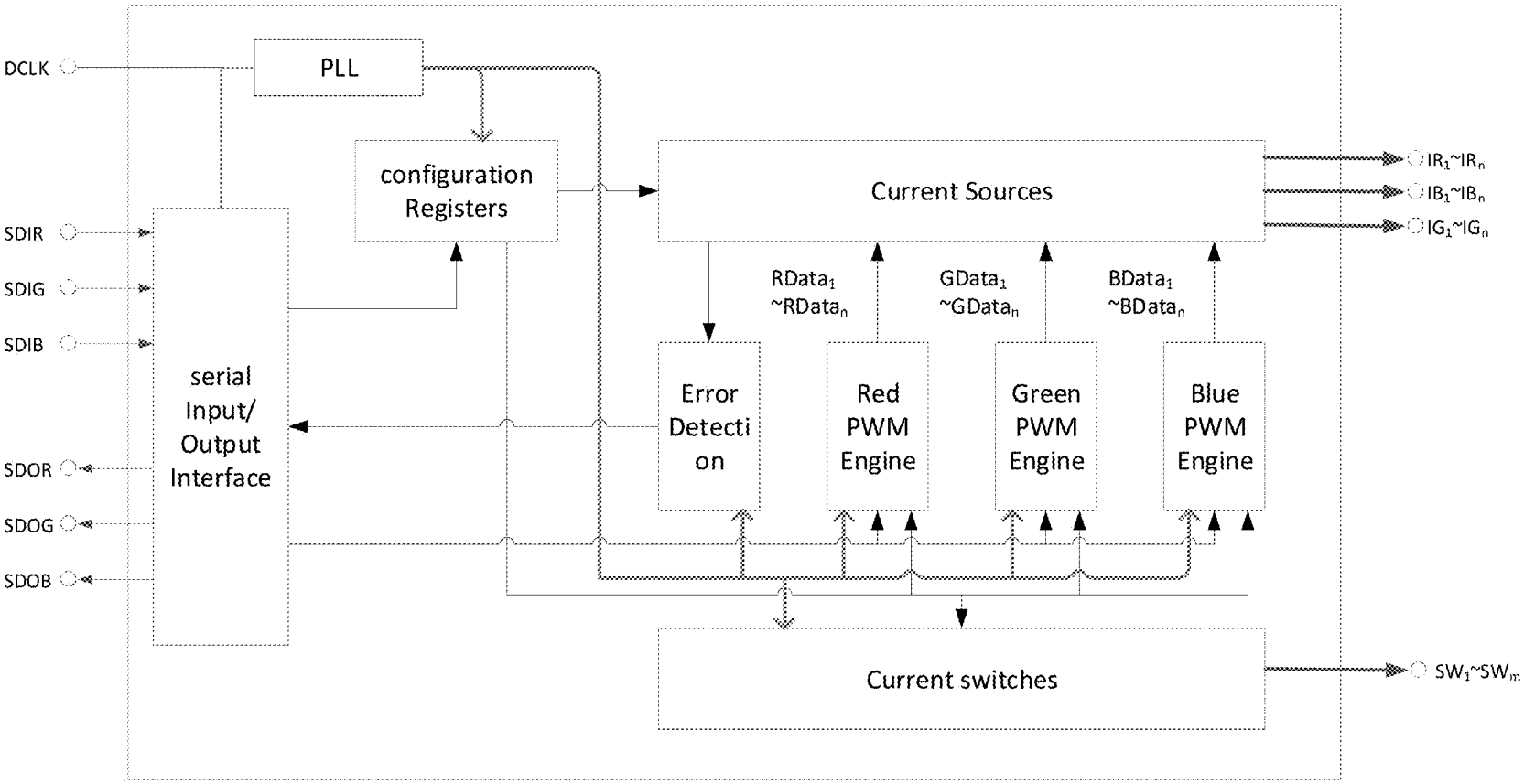
FIG. 6 is a block diagram of the driver circuit in the system of FIG. 5.

FIG. 6 shows an exemplary driver circuit suitable for the driver chip in FIG. 5, which drives the m×n array of RGB LED pixels. The driver circuit includes an on-chip phase locked loop (PLL), a serial input/output interface, a configuration register circuit, a gain adjustable current source circuit that supply m×3 number of LED channels, an error detection circuit, three pulse width modulation (PWM) engines (red PWM engine, green PWM engine, and blue PWM engine), and a current switches circuit that control m number of scan switches.

The on-chip PLL block generates an accurate and high frequency global clock signal GCLK. It may do so by having an internal GCLK (global clock buffer) or by receiving external GCLK signals from the SendBox. The global clock signal serves as the clock input for the PWM engines within the driver IC. The DCLK (dot clock) serves as an input reference clock for the PLL.

The serial input/output interface is used to load driver IC settings into the configuration registers, to load gray scale values to the PWM engines, and to load DOT correction settings into the memory within the gain adjustable current source circuit. It is also the interface to read out configuration settings from the configuration registers and the error status from the error detection circuit. SDOR, SDOG, and SDOB are serial data outputs that are connected with SDIR, SDIG, and SDIB (serial data input to a shift register) of an adjacent driver IC.

The configuration registers store the various settings for the LED driver IC. These settings may be defined as a 16-bit register for each color channel, e.g., red, blue, and green. The gain adjustable fast charge current source circuit provides a stable current source output based on the PWM signal from the PWM engines. The output current from the current source circuit is adjusted based on the driver setting. There are two levels of gain adjustments: one is a global adjustment per color, the other is a DOT correction adjustment per output LED.

The error detection circuit monitors the channel output from the current source block to detect short circuit and report the status back to the serial input/output interface block. During the operation, if there is a short within an LED, the voltage drops across the LED will become minimal. The error detection circuit detects that the voltage drop is lower than the short threshold and flags a short LED.

The PWM engines are responsible for generating PWM pulses for each of the m×3 channels. For each channel, it loads 16-bits gray scale values, one per each of the n scan lines. The PWM engines output PWM pulses with the width of the pulse matching the gray scale set to the channel. For a single channel, the PWM engine circuit output loops through all scan lines and provides gray scale output level ranging from 0 to 65535 (i.e., $2^{16}$).

The current switches circuit receives scan line address signals from the configuration registers and translates them into scan line switch input signals to control scan switches. The scan switches turn ON or OFF the LED pixels one scan line after another according to the control signal.

The timing of the PWM pulses can be either controlled by the on board digital controller in the SendBox or by the PWM engines on the driver chip in the system such as the one depicted in FIG. 5. When the timing is controlled by the SendBox, the start time and the stop time of the pulses (i.e., duration) are determined by timing signals sent to the driver chip from SendBox.

Figure 7:
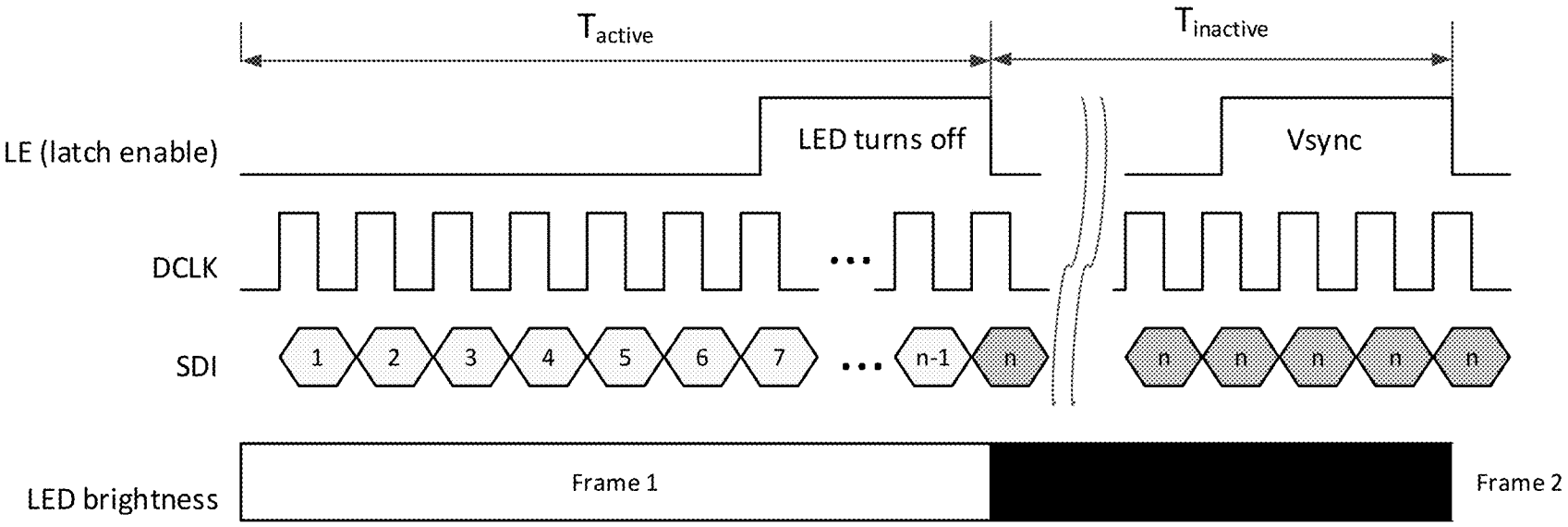
FIG. 7 is a timing diagram according to one embodiment of the current disclosure.

FIG. 7 illustrates an exemplary timing diagram of the current disclosure using the system of FIG. 5 when the timing is controlled by the On-Board-Digital-Controller in the SendBox. Specifically, one complete Frame 1 includes a write configuration timing, a gray scale timing, and $V_{sync}$ that provides a buffer for the pixels to get ready for the next frame. According to one embodiment of the current disclosure, one frame time is divided into $T_{active}$ and $T_{inactive}$. The latch enable (LE) signal is negative edge active so that its negative edge toggles the LED from ON to OFF. In this case, the LE signal from the SendBox toggles the LED to OFF at the end of the $T_{active}$ period. Accordingly, Frame 1 is divided into an active period when the LED is lit and an inactive period when the LED is dark, indicated by the LED brightness.

Figure 8:
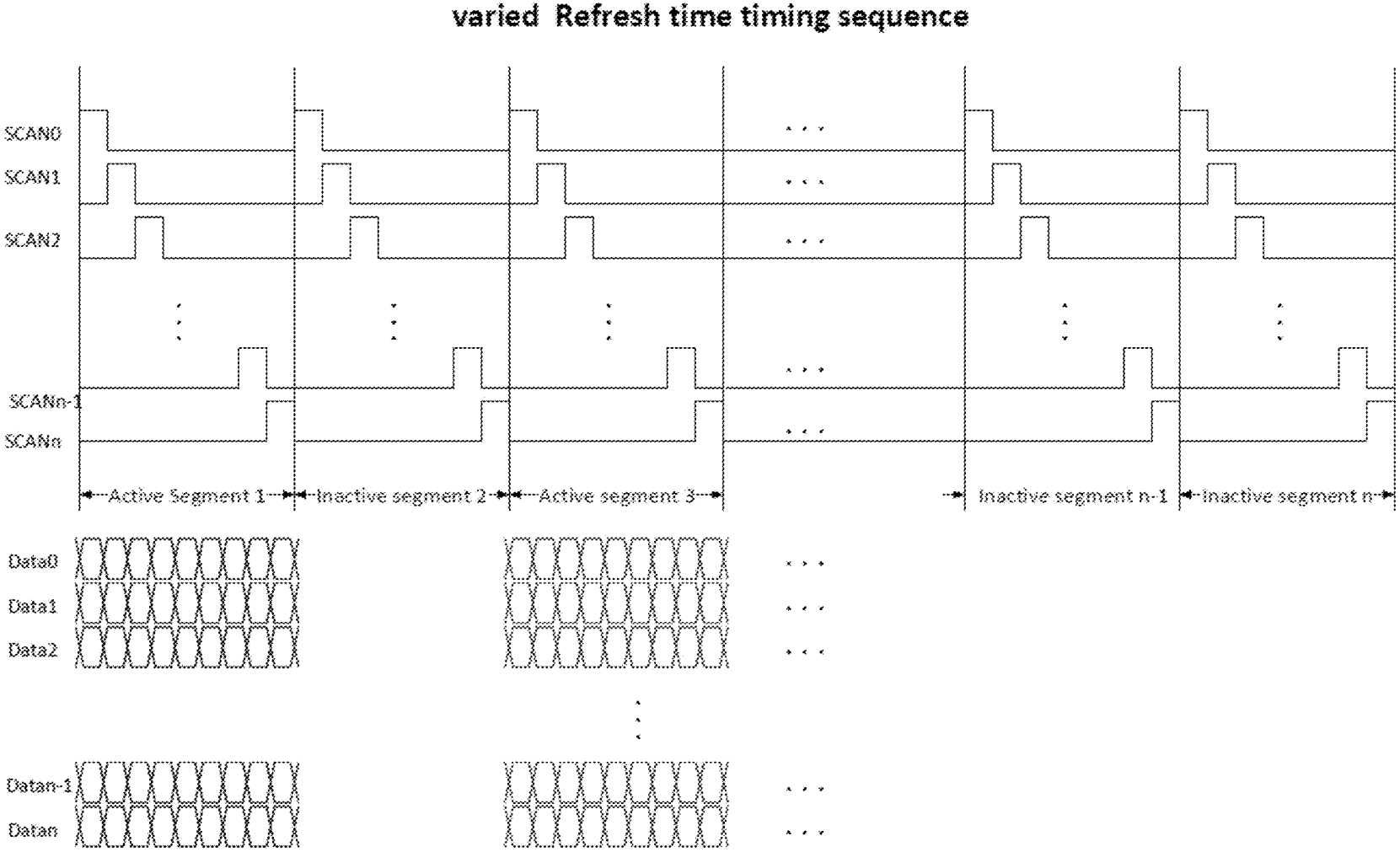
FIG. 8 shows the timing sequence according to another embodiment of the current disclosure.

According to a further embodiment, the timing of the LED pixels is controlled by the PWM engine on the driver chip. In this case, the SendBox sends the configuration data, including the driver setting, to configuration registers on the driver chip. As the output current from the current source circuit is adjusted based on the driver setting, the command can be included in the configuration data to turn ON or OFF the output current. Accordingly, the driver circuit determines the output current in which time segments will be ON or OFF to accomplish the desired timing sequence. For example, in the $T_{frame}$ shown in FIG. 8, the PWM engine provides data to Segments 1 and 3 and leaves the remaining n−2 segments dark. In this manner, the PWM engine may selectively light up different segments. As long as a continuous $T_{inactive}$ is realized.

In some embodiments the driving current in all segments in $T_{active}$ are ON, such as shown in FIG. 3. In other embodiments, in some segments in $T_{active}$, the driving current is turned OFF, such as shown in FIG. 4. In addition, $T_{inactive}$ period can be determined according to commands (e.g., LE signals) from the SendBox while the PWM pulse pattern can be determined according to configuration data on the driver circuit, which controls the PWM engine.

$T_{inactive}$ can be set to a value that is equal to or larger than ($T_{persistence}-T_{refresh}$). Alternatively, $T_{inactive}$ can be obtained by calibrating the LED display for motion blur. For example, the length of $T_{inactive}$ can be obtained by adjusting the length of inactive period until there is no detectable motion blur. Other optical effects of $T_{inactive}$, such as flickering, uniformity of brightness, may also be taken into consideration when determining $T_{inactive}$ to obtain an optimal image quality.

Therefore, the scope of the disclosure is defined not by the detailed description, but by the claims and their equivalents, and all variations within the scope of the claims and their equivalents are to be construed as being included in the disclosure.

What is claimed is:

1. A method for reducing motion blur in an LED display system, comprising:

connecting an LED display panel to a driver circuit, wherein the driver circuit comprises a plurality of PWM engines, a plurality of configuration registers, a plurality of current sources, and a plurality of switches that are signally connected;

sending, from a transmitter, image data in a plurality of image frames at a predetermined frame rate and a predetermined refresh rate to the driver circuit, wherein each of the plurality of image frames has a frame time period ($T_{frame}$) comprising a plurality of refresh time periods ($T_{refresh}$);

outputting a driving current from the driver circuit to drive the LED display panel;

dividing $T_{frame}$ into a first time period ($T_{active}$) and a second time period ($T_{inactive}$), wherein $T_{inactive}$ bridges two adjacent frame time periods; and turning off the driving current during $T_{inactive}$, wherein $T_{inactive}$ has a value that is larger than or equal to ($T_{persistence}$-$T_{refresh}$), wherein $T_{persistence}$ is a time period for persistence of vision of human eye.

2. The method according to claim 1, further comprising: adjusting a length of a time period when the driving current is turned off; recording the length of the time period when motion blur is at an acceptable level; and setting $T_{inactive}$ to a value at or higher than a recorded length of time period.

3. The method according to claim 1, further comprising sending, from the transmitter, a control signal that turn off the driving current to implement $T_{inactive}$.

4. The method according to claim 3, wherein the control signal is a latch enable signal.

5. The method according to claim 1, further comprising sending, from the transmitter, a configuration data to the plurality of configuration registers in the driver circuit, wherein the driving current is turned off according to the configuration data.

6. The method of claim 1, wherein the driving current is ON in all refresh time periods during $T_{active}$.

7. The method of claim 1, wherein the driving current is OFF in one or more refresh time periods during $T_{active}$.

* * * * *